United States Patent [19]

Führing

[11] 4,137,646

[45] Feb. 6, 1979

[54] DRUM-TYPE DRIER FOR FABRIC

[75] Inventor: Heinrich Führing, Augsburg, Fed. Rep. of Germany

[73] Assignee: Böwe Böhler & Weber KG, Augsburg, Fed. Rep. of Germany

[21] Appl. No.: 806,462

[22] Filed: Jun. 14, 1977

[30] Foreign Application Priority Data

Jun. 15, 1976 [DE] Fed. Rep. of Germany ... 7618897[U]

[51] Int. Cl.[2] ..... F26B 11/02

[52] U.S. Cl. ..... 34/75; 34/77; 34/115

[58] Field of Search ..... 34/75, 77, 122, 109, 34/114, 115

[56] References Cited

U.S. PATENT DOCUMENTS

| | | | |
|---|---|---|---|
| 1,738,641 | 12/1929 | Cowan | 34/114 |
| 2,189,915 | 2/1940 | Mellor et al. | 34/77 |
| 3,002,287 | 10/1961 | Smith | 34/77 |
| 3,098,371 | 7/1963 | Fleissner | 34/115 |
| 3,134,652 | 5/1964 | D'Angelo et al. | 34/77 |
| 3,303,576 | 2/1967 | Sisson | 34/122 |
| 3,440,736 | 4/1969 | Fleissner et al. | 34/115 |
| 3,676,937 | 7/1972 | Janson | 34/77 |
| 3,727,325 | 4/1973 | Fleissner et al. | 34/115 |
| 3,945,131 | 3/1976 | Küsters et al. | 34/122 |

*Primary Examiner*—Martin P Schwadron
*Assistant Examiner*—H. Jay Spiegel
*Attorney, Agent, or Firm*—Karl F. Ross

[57] ABSTRACT

A drum-type drier for fabric in which the drying drum has a perforated periphery and is mounted in a housing for rotation about a horizontal axis. The housing has, opposite an end wall of the drum, at least one door or flap. The fabric web is guided over the periphery of the drum. According to the invention, the cooler for the drying gas, generally air, is mounted within the housing on this door or flap.

7 Claims, 2 Drawing Figures

DRUM-TYPE DRIER FOR FABRIC

FIELD OF THE INVENTION

The invention related to a drum-type drier in which a fabric web is guided along the periphery or circumference of the drum and is dried by passing a drying gas through the fabric at least in part through the periphery of the drum which can be perforated to permit such passage. More particularly, the invention relates to an improved system of the aforedescribed type in which the drying drum is mounted in a housing for rotation about a substantially horizontal axis.

BACKGROUND OF THE INVENTION

It is known to provide a drum-type drier in which a drying drum is rotably mounted in a housing and has a horizontal axis, means being provided to effect a passage of a drying gas, generally heated air or some other gas, generally radially through the fabric web which is guided onto and passes around the perforated periphery of the drum.

In this system, the housing may be formed with a slot or gap in at least one of the vertical longitudinal walls through which the fabric web enters the housing and leaves the housing, the web passing over suitable guide means. Within the housing the web lies upon the major part of the cylindrical surface of the perforated drum and means is provided for inducing a flow of the drying gas through the fabric web while the latter is on the drum. Generally the drying gas is air, as noted previously, the air being heated in a heat exchanger, passing through the fabric web and the drum in a radial direction, and being cooled in a condenser or the like at which moisture is removed from the air. The air can then be recirculated to the heater and discharged into the atmosphere.

The displacement of the air stream is effected generally by a blower or fan. In most prior-art systems of this type, the cooler is disposed externally of the housing and is traversed by the moisture-laden air stream or the air stream laden with vapors of a solvent with which the fabric has been treated. Generally the fabric to be dried contains water or an organic solvent, the fabric arriving from a fabric-treatment station, e.g. a dyeing installation.

In the external cooler, the vapors of the treating liquid, e.g. water or organic solvent such as perchloroethylene, are condensed.

Usually and preferably, the air after contact with the cooler is recirculated, i.e. is displaced in a closed cycle from the cooler to an air heater before the air flows anew into contact with the textile web covering the major part of the cylindrical periphery of the drum.

Arrangements in which the cooler or, more generally, the heat exchanger for contact with the air stream and vapor condensation, is located externally of the housing are space-consuming and pose problems with respect to sealing against the environment. Frequently the heat exchanger is relatively inaccessible for maintenance and, if accessible at all, requires time-consuming measures to obtain access.

OBJECT OF THE INVENTION

It is the object of the present invention to provide an apparatus of the type described which is capable of affording not only effective condensation of the water or solvent vapor from the drying air stream, but also is quickly and inexpensively accessible for maintenance, the apparatus having a relatively low cost and particularly rational construction vis-a-vis the air circulation path.

SUMMARY OF THE INVENTION

This object and others which will become apparent hereinafter are attained, in accordance with the present invention, by providing a drying drum of the character described which is rotatably mounted in a housing having an end wall opposite and end of the drum which is formed as a door or flap and upon the inner surface of which a heat exchanger for contact with the gas stream is provided. More specifically, the invention provides that the air cooler and vapor condenser for the circulating air stream is disposed on the inner surface of at least one door or flap removable from or swingable upon the remainder of the housing and disposed opposite an axial end of the drum.

It is also within the purview of the invention to provide the air cooler/condenser on a fixed portion of the housing directly adjacent the door or flap so that, upon opening of the door or flap, the air cooler/condenser spans or lies within the opening formerly covered by the door or flap for maintenance and access.

In any case, the air cooler/condenser is disposed between the movable door or flap and the end of the drum with which the latter is juxtaposed. According to a feature of the invention, the moisture-laden air is conducted out of the drum through at least one axial end thereof to traverse the air cooler/condenser juxtaposed with this end of the drum, the air initially coming into contact with the air cooler/condenser in an axial flow direction. The vapors contained in the air stream, generally water vapor or solvent vapor, are condensed upon contact with the cold surfaces of the cooler/condenser.

With this orientation of the cooler/condenser, it is especially easily accessible, requires no special mounting structures or housing and hence can be readily maintained and assembled to the remainder of the structure. Furthermore, the capital cost of the drier is reduced.

According to a feature of the invention, the conduits for supplying the cooling fluid to and removing the cooling fluid from the air cooler/condenser pass directly through the door or flap so that the assembly of the condenser to or its removal from the remainder of the apparatus can be effected by mounting the door upon or removing the door from the wall of the housing. In other words, upon opening and closing of the door or flap, without any other special manipulation of the cooler/condenser, the latter is placed in position to operate for condensation of vapors from the gas or is disposed in a position in which it can be examined or maintained. Manipulation of the conderser/cooler is thereby greatly facilitated.

According to the invention, moreover, the door or flap can be provided with fixed rigid fittings which are rigidly connected, in turn, with the cooler/condenser, the fittings being in turn connected with the cooler-circulating system by flexible pipes or hoses.

It has been found to be advantageous if the cylindrical surface of the drum is provided with perforations or openings in the usual manner and, in addition, the end walls of the drum are formed with openings or windows for more effective utilization of the cooler which is disposed immediately ahead of these windows in the axial direction of the drying-fluid flow.

Drying efficiency is further improved when, in the region between the drum end wall and the door or doors a space is provided which communicates with the suction side of the blower or ventilator by which the air is circulated into contact with the cooler/condenser. The intake side of the blower can thus open at one of these doors or flaps so that the drying air stream is caused to traverse the cooler/condenser in a continuation of its axial flow direction from the end of the drum to the blower. The space between the cooler/condenser and the respective end wall of the drum can be provided with tiltable baffles or the like for improving the flow of the gas into contact with the surfaces of the cooler/condenser, the baffles or vanes being in the form of a jalousie which uniformly distributes the circulated air into contact with the full surface of the cooler/condenser juxtaposed with the respective end wall of the drum.

It has also been found to be advantageous to provide a plenum for the intake side of the blower or ventilator which opens into the spaces between each of a pair of oppositely disposed cooler/condensers and the respective ends of the drum, thereby drawing the air downwardly from the aforementioned spaces. After heating, the air can be recirculated to a housing surrounding the cylindrical periphery of the drum so as to pass radially through the web and the latter.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
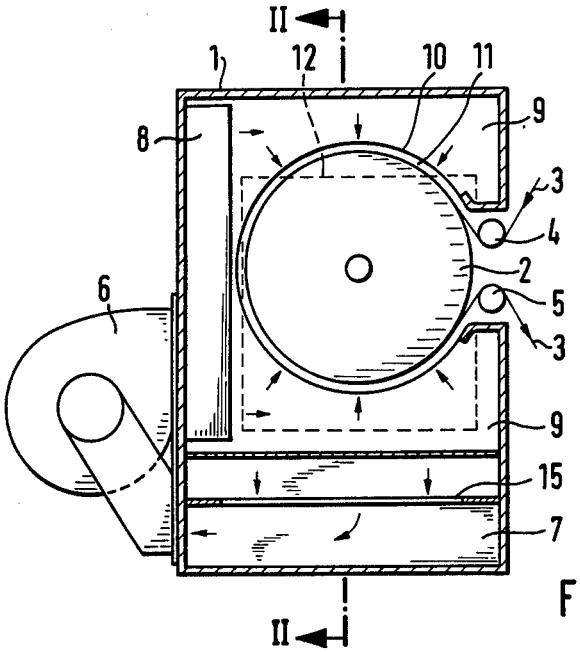
FIG. 1 is a vertical cross-sectional view, partly in diagrammatic form, through the housing of a drum-type dryer according to the invention in a plane perpendicular to the axis of rotation of the drying drum.

In the drawing, there is shown a drum-type drier which comprises a rectangular parallelpipedal housing 1 in which a drum 2 is rotatable about a horizontal axis.

The drum 2 has a perforated cylindrical periphery about which a textile web 3 is guided, the textile web 3 arriving from a fabric-treatment station in which it has been wetted, possibly with water but generally with an organic treating solvent.

One of the vertical longitudinal walls of the housing is provided, over the length of the drum, with an inlet slot along which a pair of deflecting rollers 4 and 5 are disposed, the roller 4 being positioned spacedly above the roller 5. The web 3 passes under the roller 4 and onto the drum 2 substantially at the three-o'clock position, the web then extending around the greater portion of the circumference of the drum and then passing over the lower roller 5 upon leaving the drum in the direction of the arrows in FIG. 1. The web also leaves the housing at about the three-o'clock position.

Figure 2:
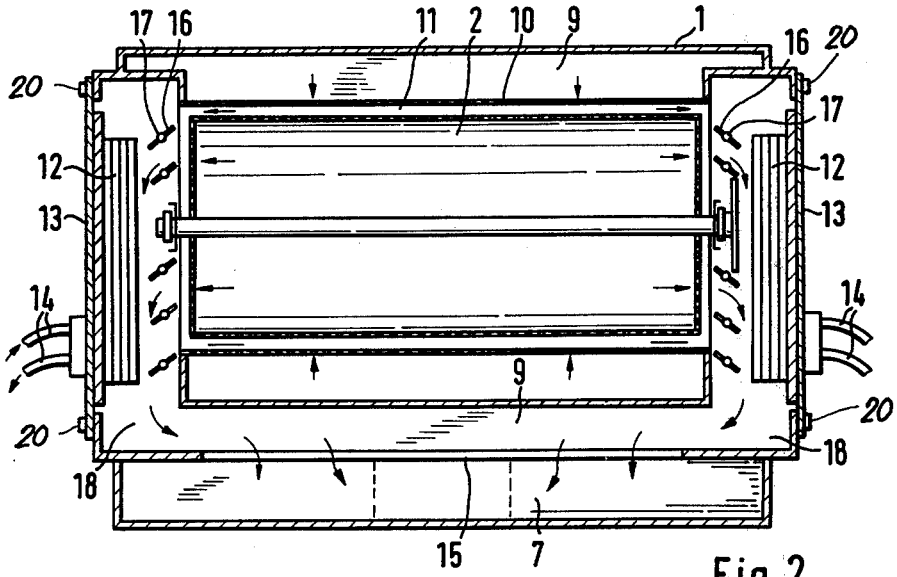
FIG. 2 is a cross-sectional view taken along the line II—II of FIG. 1 and corresponding generally to a section through the apparatus along the drum axis.

As also represented by arrows in FIGS. 1 and 2, the air flow for drying the web derives from a blower 6, the air being drawn at the intake of the blower from a plenum chamber 7 formed along the floor of the housing. The air passes over an air heater 8 and is blown into the pressure chamber 9 which is defined around the cylindrical periphery of the drum. The perforations or air nozzles formed in a cylindrical wall 10 spaced slightly from the periphery of the drum, distribute the air over the entire periphery thereof substantially uniformly. This perforated or nozzled surface directs the air radially through the web and into the perforations of the cylindrical drum surface.

Thus the web is traversed radially by the air or deflects the air axially in the gas between the periphery of the drum and the nozzle or perforated wall 10. Within the drum and the gap 11, therefore, the air flows parallel to the axis of the drum into a space between each end surface or wall of the drum and a juxtaposed wall of the housing, the juxtaposed wall being formed as a door or flap 13.

The end walls of the drum 2 are also perforated or formed with windows through which the vapor-laden air can enter the aforementioned gaps.

The air in these gaps contacts the cooler/condenser heat exchangers which are disposed on the inner surface of each door or flap 13 so that the vapors condense and can be recovered by troughs (not shown) on the bottom edges of the cooler/condensers. The flaps 13 are removably held at the housing 1 by rotatable locks 20 at the corners of the flaps.

The air passes downwardly through the passage 18 and the sieve 15 into the plenum 7 and then to the blower 6.

As previously indicated, the cooler/condenser 12 opposite each end of the drum 2 has cooling surfaces which are contacted by the air flowing over same to condense the vapors entrained with the drying air. Each of these cooler/condenser units is mounted on the inner surface of a door flap 13 which is removably fixed to the remainder of the housing 1. In FIG. 1, the door flap is shown only by broken lines.

The feed and discharge fittings 14 also extend through the door flap 13 and can be fixed thereto, the fittings being connected by hoses to the coolant circulation system.

Consequently, by the simple mounting and dismounting of the door flap, the mounting or removal of the cooler/condenser can be achieved. Upon dismounting of the door flap, therefore, the cooler/condenser can by subjected to maintenance operations.

In the space between each end wall of the drum and the respective cooler 12, there are provided air-guide vanes 16 each tiltable about a horizontal axis 17 and forming a jalousie-type deflector which can distribute the air over the respective cooler and determines the proportion of the recirculated air which comes into contact with the cooling surfaces.

I claim:

1. A drum-type drier comprising:

a housing;

a drying drum journaled in said housing for rotation about a horizontal axis;

means for feeding a textile web over the periphery of said drum;

means for distributing a drying gas over said web, said housing being formed with a pair of walls each juxtaposed with an end of said drum and disposed along said axis, at least one of said walls forming a door affording access to the interior of said housing; and a cooler for said gas lying along said axis between an inner surface of said door and the respective end of said drum and rendered accessible upon opening of said door, said cooler being formed with inlet and outlet fittings for a coolant adapted to traverse said cooler, said fittings extending through said door, said drum having a perforated cylindrical periphery traversed by said gas and said end of said drum being formed with windows open toward said cooler, the axis intersecting the cooler.

2. The drum-type drier defined in claim 1, further comprising an array of adjustable vanes each swingable about a horizontal axis for distributing the gas emerging from said one of said ends of said drum over said cooler.

3. The drum-type drier defined in claim 1 wherein said cooler is spaced from said one of said ends of said drum, the space between said cooler and said one of said ends being connected to an intake side of a blower.

4. The drum-type drier defined in claim 1 wherein said housing is formed with a plenum chamber below said drum, each of said walls is formed with an openable door and carries a respective cooler spacedly juxtaposed with a respective end of said drum, the spaces between said ends of said drum and the respective cooler communicating with said chamber, said drier further comprising a blower having an intake side connected to said chamber and a discharge side communicating with a gas heater.

5. The drum-type drier defined in claim 4 wherein said housing is formed with a perforated wall juxtaposed with the periphery of said drum and defining a gas distributing compartment in said housing whereby said gas from said heater is directed inwardly generally radially onto said web on said drum, said drum having a cylindrical perforated periphery traversed by said gas upon its passage through said web, said ends of said drum having openings directing the gas from the interior of said drum toward the respective coolers.

6. The drier defined in claim 5, further comprising a vertical array of horizontally extending vanes tiltable about horizontal axes in each of said spaces.

7. The drier defined in claim 6 wherein each of said coolers is formed with inlet and outlet fittings extending through the respective door and connected with respective hoses.

* * * * *